US011255625B2

(12) United States Patent
Collins

(10) Patent No.: US 11,255,625 B2
(45) Date of Patent: Feb. 22, 2022

(54) MUZZLE BRAKE

(71) Applicant: Ethan A. Collins, Huntington, WV (US)

(72) Inventor: Ethan A. Collins, Huntington, WV (US)

( * ) Notice: Subject to any disclaimer, the term of this patent is extended or adjusted under 35 U.S.C. 154(b) by 0 days.

(21) Appl. No.: 16/733,048

(22) Filed: Jan. 2, 2020

(65) Prior Publication Data

US 2021/0207918 A1 Jul. 8, 2021

(51) Int. Cl.
*F41A 21/36* (2006.01)
*F41A 21/38* (2006.01)

(52) U.S. Cl.
CPC ..... *F41A 21/36* (2013.01); *F41A 21/38* (2013.01)

(58) Field of Classification Search
CPC ..... F41A 21/36; F41A 21/38; F41A 21/34; F41A 21/32; F41C 27/00
See application file for complete search history.

(56) References Cited

U.S. PATENT DOCUMENTS 1,605,393 A 11/1926 Cuffs, Jr.
1,636,357 A 7/1927 Cuffs, Jr.
2,212,685 A 8/1940 Hughes
2,212,686 A 8/1940 Hughes
2,313,669 A 3/1943 Reising
2,322,370 A 6/1943 Lance
2,953,972 A 9/1960 Sorensen
3,707,899 A 1/1973 Perrine
4,322,999 A 4/1982 Aston
4,429,614 A 2/1984 Tocco
4,545,285 A 10/1985 Mclain
4,930,397 A * 6/1990 Seidler ..... F41A 21/325 89/14.3
4,944,213 A 7/1990 Ewert
5,020,416 A 6/1991 Tripp
5,076,137 A 12/1991 Paredes
5,092,223 A 3/1992 Hudson
5,225,615 A 7/1993 Talbot et al.
5,476,028 A 12/1995 Seberger
5,563,362 A 10/1996 York
6,269,727 B1 8/2001 Niggle
6,604,445 B2 8/2003 Sevastian
7,032,339 B1 4/2006 Bounds
D534,235 S 12/2006 Price
(Continued)

FOREIGN PATENT DOCUMENTS

WO WO 2018/005853 * 1/2018

*Primary Examiner* — Joshua E Freeman
(74) *Attorney, Agent, or Firm* — Brian W. Foxworthy; Robert R. Waters; Waters Law Group, PLLC

(57) ABSTRACT

A muzzle brake has body having a muzzle end and an exit end with at least one side connecting the ends. A muzzle aperture in the muzzle end is sized and configured to fit a firearm muzzle. A projectile aperture in the exit end extends to the muzzle aperture. A line segment within the space of the muzzle aperture aligns with the centerline of the firearm and defines a projectile line through the body. Apertures pass through the body with their generating lines being perpendicular to the projectile line. The apertures are shaped to allow more gases to escape in one direction and to contain gases in the opposing direction. This causes the gases to exert forces on the muzzle brake which compensates for the tendency of the muzzle to rise when the firearm is fired.

12 Claims, 14 Drawing Sheets

(56) References Cited

U.S. PATENT DOCUMENTS

| | | | | |
|---|---|---|---|---|
| D536,054 | S | 1/2007 | Price | |
| 8,042,448 | B1 * | 10/2011 | Sylvester | F41A 21/36 89/14.3 |
| 8,061,254 | B2 * | 11/2011 | Heath | F41A 21/34 89/14.2 |
| D682,972 | S | 5/2013 | Kasanjian-King | |
| D687,508 | S | 8/2013 | Peterman | |
| 8,578,832 | B2 | 11/2013 | Adolphsen | |
| D729,894 | S * | 5/2015 | DeLuca | D22/108 |
| 9,228,789 | B1 | 1/2016 | Oglesby | |
| 9,303,939 | B1 * | 4/2016 | Brinkmeyer | F41A 21/38 |
| D759,188 | S | 6/2016 | Geissele | |
| D760,859 | S | 7/2016 | Venegas | |
| D767,076 | S * | 9/2016 | Bebee | D22/108 |
| 9,683,802 | B2 | 6/2017 | Geisselle | |
| D828,899 | S | 9/2018 | Pierce | |
| 10,126,085 | B2 | 11/2018 | Deros | |
| D835,226 | S * | 12/2018 | Haman | D22/108 |
| 10,156,412 | B1 | 12/2018 | Price | |
| D842,960 | S | 3/2019 | Liu | |
| 10,337,820 | B2 | 7/2019 | Jager | |
| 2005/0188829 | A1 | 9/2005 | Hanslick et al. | |
| 2007/0107590 | A1 | 5/2007 | Silvers | |
| 2010/0269387 | A1 | 10/2010 | Drajan | |
| 2010/0275492 | A1 | 11/2010 | Moller et al. | |
| 2016/0169606 | A1 * | 6/2016 | Joplin | F41A 21/36 42/1.06 |
| 2019/0011209 | A1 | 1/2019 | Chavez | |
| 2019/0101350 | A1 | 4/2019 | Hall et al. | |
| 2020/0103195 | A1 * | 4/2020 | Joplin | F41A 21/38 |

* cited by examiner

MUZZLE BRAKE

FIELD OF INVENTION

The present application is generally related to a muzzle brake device. More specifically, the present application relates to a muzzle brake device that compensates for the forces that cause the rise produced in a firearm when it is fired, and a projectile exits its muzzle.

BACKGROUND OF THE INVENTION

The use of firearms is ubiquitous. When a firearm is fired, the initial acceleration of the projectile by gases expanding in the barrel of the firearm produces an initial recoil, or "push back". Additionally, when a projectile exits the end of the firearm's barrel, there are two phenomena which accompany the exit of the projectile. One is the production of a flash, and the other is the escape of the gases that propel the projectile. The escaping gases generate two effects, continued recoil back toward the operator of the gun and a (very) loud noise. There are various muzzle brakes that attempt to suppress the flash, suppress the noise, or mitigate the recoil. Some muzzle brakes that are directed toward mitigating the escaping gases attempt to decrease the amount of recoil, or the "push back" from the escaping gases. Other muzzle brakes attempt to mitigate a related effect which is the rise that can be produced at the end of a barrel by the escaping gases. As the firearm is shot, the recoil generated by the acceleration of the projectile and the escaping gases can cause the firearm to rise from its initial position when it is fired. For situations where it is desired to maintain high accuracy in quick succession after a first firing of a firearm, the rise of the barrel can have a bad effect on the accuracy of the shots. The operator must move the firearm from where it is displaced by the rise caused by the gases and return it to the target each time. The less adjustment an operator has to make, the better accuracy that can be achieved for multiple shots.

Relevant Art

U.S. Pat. D534,235 by Price is for a "MUZZLE BRAKE". U.S. Pat. D687,508 by Peterman is for a "FIREARM COMPENSATOR". U.S. Pat. D729,894 by DeLuca is for a "MUZZLE BRAKE FOR AN ASSAULT RIFLE". U.S. Pat. D760,859 by Venegas is for a "MUZZLE BRAKE". U.S. Pat. D767,076 by Bebee is for a "MUZZLE BRAKE".

U.S. Pat. No. 5,076,137 by Paredes is for "DYNAMIC ACTION COMPENSATOR FOR HANDGUNS". In Paredes, a compensator is disclosed and claimed. The compensator has a primary venting system that directs high pressure gas in a downward direction, thereby creating a dynamic or resistive force as the gas bears on the bottom surface of the compensator housing before being redirected at upward angles. This primary venting system works to push the compensator down to thereby negate muzzle flip. A secondary venting system, which consists of one (or more) cylindrical gas expansion chamber(s) forward of the downward vent, works in combination with the primary system by allowing residual lower pressure gases to expand and disrupt within the expansion chamber(s) before being vented in an upward direction. This secondary system creates a passive action in that the gas is not directed to bear on any particular surface, but is allowed to expand and bear on all available surfaces before venting upward thereby creating an additional downward force further reducing muzzle flip.

U.S. Pat. No. 10,156,412 by Price is for "MUZZLE BRAKE WITH PROPELLING NOZZLE FOR RECOIL CONTROL". In Price, the muzzle brake attaches to a distal end of the barrel of a firearm, typically a handgun, either built into the firearm or as an accessory attachable to the firearm. The muzzle brake includes a propelling nozzle in the form of a central chamber aligned with proximal and distal openings aligned with a barrel of the firearm. This propelling nozzle extends upward, generally expanding in cross-section, to a rim where it opens above the firearm near a distal end of the barrel. The shape of the propelling nozzle (or series of nozzles) is preferably selected to optimize downward reactive force when expanding gases discharged from the firearm discharge and expand upward out of the propelling nozzle. A downward reactive force is thus created which counteracts recoil of the firearm.

U.S. Pat. No. 4,429,614 by Tocco is for "SLIP ON COMPENSATOR FOR REVOLVERS". In Tocco, a generally cylindrical tubular member is provided with securing means for detachably securing the member to a hand gun such that the member is positioned forwardly of the end of the gun barrel, and so that the cylindrical body member is aligned with the bore of the hand gun. The cylindrical body member is formed with a clamping mechanism on the opposite end which, when clamped, causes the compression of a resilient spacer member and an annular resilient insert member which are disposed around the barrel of the hand gun. The compressing forces developed by the clamping mechanism cause the resilient members to frictionally engage the barrel without damaging the barrel. The cylindrical body member also has an aperture slot formed in a selected portion of the wall forming the cylindrical body member, such that gases generated during the ignition of a related bullet assembly may escape in a generally upward direction. This action creates generally downwardly directed reaction forces assisting in maintaining the fired firearm stable and at least significantly eliminates the usually experienced upward jump of such fired hand guns.

U.S. Pat. No. 2,953,972 by Sorenson is for "MUZZLE EQUALIZER AND BLAST MINIMIZER FOR GUN". In Sorenson, the body of the blast minimizer is attached to the end of a barrel by a collect section of the minimizer that fits over the end of the barrel. An angular notch is cut transversely of the minimizer body at a location that places it immediately in the front of the end of the barrel and deep enough to penetrate to the bore of the minimizer. The rear face of the cut is vertical, while the forward face of the cut slants forwardly and upwardly. This creates a rearward facing slanting surface. As the gases exit the barrel, part of the gases expand upward through the notch and also bear upon the rearward facing surface to produce a downward force on the end of the barrel to counter the tendency of the barrel to rise.

As may been seen in reviewing the relevant art, there remains a need for a muzzle brake that compensates for the tendency of a barrel to rise while also maintaining a clear line of sight along the barrel for the operator of the gun.

SUMMARY OF EMBODIMENTS OF THE INVENTION

Embodiments of the present muzzle brake have two ends and a variety of number of sides connecting those ends. The number of sides connecting the ends will determine the cross section between the ends. For example, if an embodiment of the muzzle brake has one side connecting the ends, the muzzle brake will have a generally round cross section between the ends. This cross section may adopt any common curvature to complete itself. It may be circular, elliptical, or oval. Some embodiments of the muzzle brake may have more than one side connecting the ends, which will change the cross section. For example, if the embodiment has four sides connecting its ends, it will have a quadrilateral cross section. The individual sides need not be of equal length or match the length of the opposing side.

Embodiments of the muzzle brake have a muzzle aperture in one end. The muzzle aperture is configured and sized to fit onto the end of a gun and allow the passage of a projectile from the gun. That end may be considered the entry end since that is the end where a projective enters, or the muzzle aperture may define that end as the muzzle end. The other end of the muzzle brake has a projectile aperture in it. The projectile aperture is sized to allow the passage of a projectile from the gun and has sufficient depth to intersect the muzzle aperture. That end may be considered the exit end as it is the end where a projectile will exit. The connection of the muzzle aperture with the projectile aperture provides passage of a projectile from end to end of the muzzle brake. In some embodiments, the muzzle aperture will define a muzzle section of the muzzle brake. In those embodiments, the muzzle section has two ends of its own with one end of the muzzle section being one end of the muzzle brake.

A compensating aperture passes through the muzzle brake perpendicular to what would be the path of a projectile. The compensating aperture is defined by a plurality of sides. A containment side of the compensating aperture extends the full width of the muzzle brake and connects along one edge to an edge of a baffle side. The baffle side faces the muzzle aperture. Its edge that connects to the containment side of the compensating aperture is closer to the entry end of the muzzle brake than its opposite edge, which connects to a venting side of the compensating aperture. The different distances that the two connected edges of the baffle side have from the entry end of the muzzle brake causes the baffle side to obliquely face the entry end of the muzzle brake. A result of this is that the baffle side of the compensating aperture directs projectile propulsion gases toward the venting side of the compensating aperture. The venting side of the compensating aperture has apertures in it which allow propulsion gas to vent through the venting side. In some embodiments, the venting side has two venting apertures, one each at opposite ends of the compensating aperture. This reduces the venting side to a narrower central section. The venting side connects along an edge opposite to the baffle side to an edge of a passive side of the compensating aperture which in turn connects along an edge to the containment side of the compensating aperture. The passive side of the compensating aperture may generally be normal to the path of a projectile passing through the muzzle brake. In some embodiments, the sides of the compensating aperture connect with their respective neighbors via a radius, rather than a sharp angle.

The venting side of the compensating aperture is reduced by notches in the body of the muzzle brake at each of the venting sides. The containment side, the baffle side, and the passive side, however, all extend wider through the muzzle brake at their respective locations than the venting side. The result is that the containment side of the compensating aperture fully contains the propulsion gases on that side of the compensating aperture, the baffle side of the compensating aperture directs gases toward the venting side of the compensating aperture, and the venting side allows gases to exit the compensating aperture in a directed manner. In some embodiments, the notches that reduce the width of the venting side are oriented to further redirect the gases directed to the venting side by the baffle side. This directed exit of the propulsion gases generates a force on the muzzle brake and the firearm to which it is attached. When the muzzle brake is properly oriented, this force will reduce the rise of the muzzle of the firearm.

Some embodiments of the muzzle brake will have multiple compensating apertures which pass through the muzzle brake to generate additional compensating effect. These have a containment side that is full width of the muzzle brake and an opposing venting side that is narrower than the containment side. The multiple compensating apertures are generally aligned with each other and as they direct the gases to their respective venting sides, the resulting forces at each compensating aperture will add to the compensating force of the muzzle brake.

Each compensating aperture defines a baffle within the body of the muzzle brake with the baffle side of the compensating aperture being the face of the baffle. The material of the muzzle brake body associated with the containment sides of the compensating apertures forms a bridge, or bridges, between the muzzle section and the baffles. The material of the muzzle brake body associated with the venting sides of the compensating apertures forms a brace, or braces, between the muzzle section and the baffles. As the venting sides are shorter than the containment sides, the braces are narrower than the bridges. The angled baffle sides of the compensating apertures give the baffles an angle.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
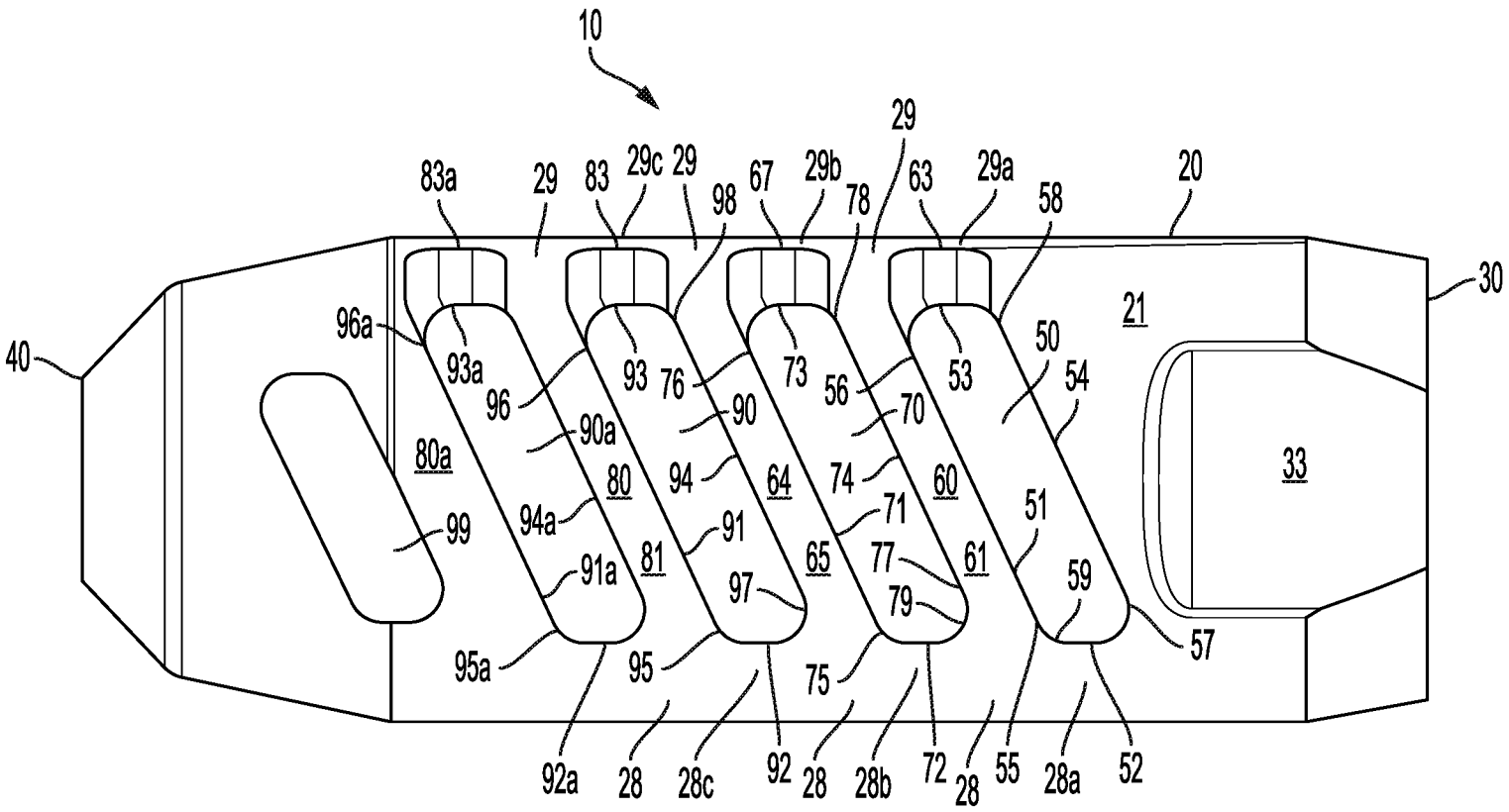
FIG. 1 is a side view of an embodiment of a muzzle brake of the present invention.
Figure 2:
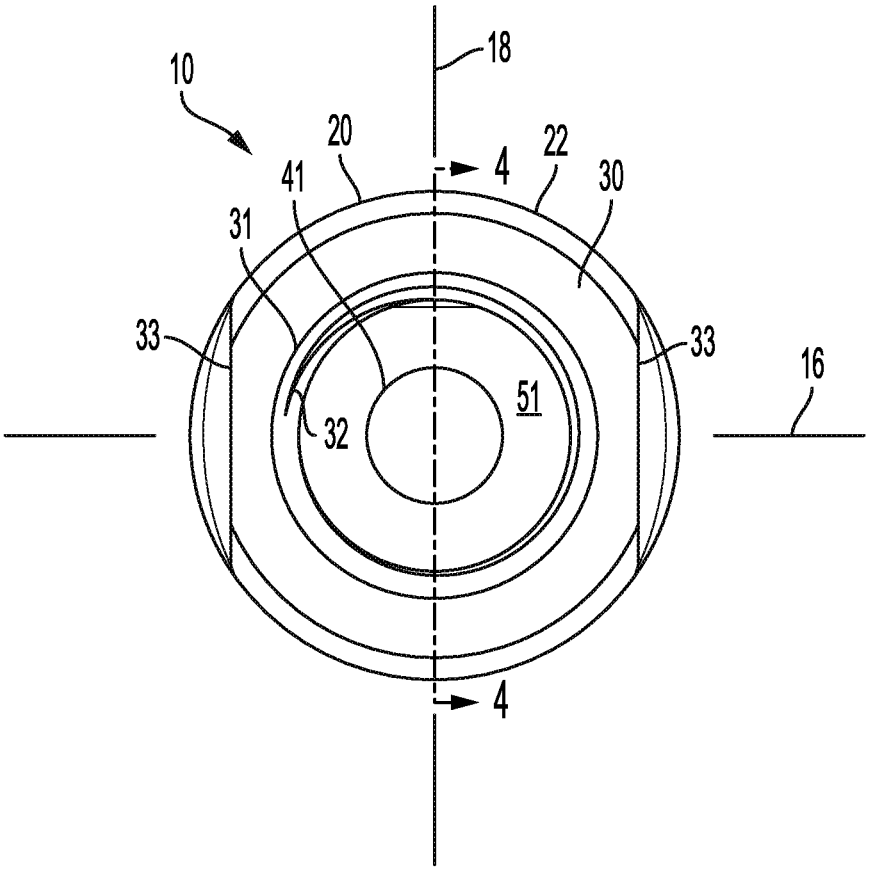
FIG. 2 is a right end view of the embodiment of the muzzle brake shown in FIG. 1.
Figure 3:
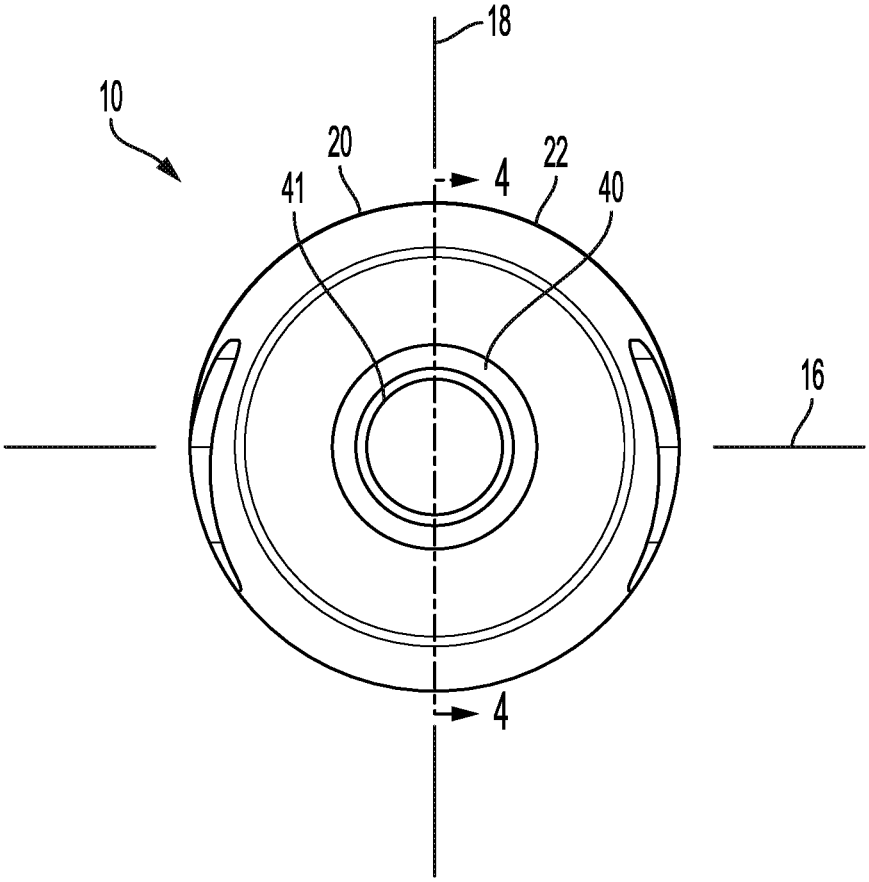
FIG. 3 is a left end view of the embodiment of the muzzle brake shown in FIG. 1.
Figure 4:
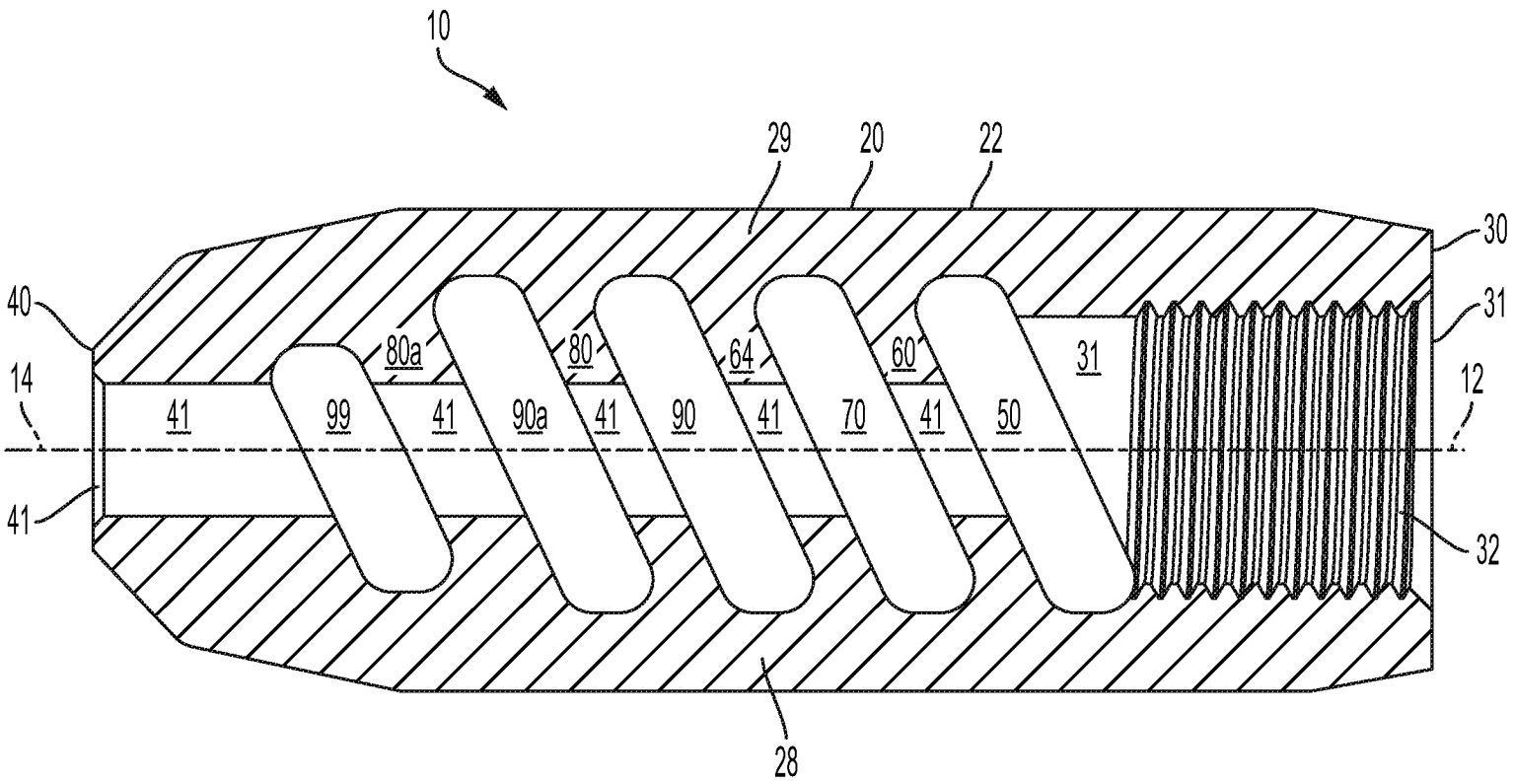
FIG. 4 is a section view of the embodiment of the muzzle brake shown in FIG. 1 along the lines shown in FIGS. 2 and 3.

FIG. 1 is a side view of an embodiment of a muzzle brake 10. Muzzle brake 10 has a body 20 with a first, muzzle, end 30 and a second, exit, end 40. FIG. 2 is a right end view of the embodiment of the muzzle brake 10 shown in FIG. 1. In FIG. 2, muzzle aperture 31 in muzzle end 30 is configured and sized to fit a gun muzzle and to allow passage of a projectile from the gun muzzle. FIG. 3 is a left end view of the embodiment of muzzle brake 10 shown in FIG. 1. In FIG. 3, projectile aperture 41 in exit end 40 is sized to allow passage of a projectile from the gun muzzle. Projectile aperture 41 is also deep enough to intersect muzzle aperture 31 and sufficiently aligned with muzzle aperture 31 to allow passage of a projectile from the gun muzzle. FIG. 4 is a section view of the embodiment of muzzle brake 10 shown in FIG. 1 along the lines shown in FIGS. 2 and 3. In FIG. 4, muzzle aperture 31 and projectile aperture 41 may be seen intersecting each other and in alignment. A line segment 12 within the space of muzzle aperture 31 will align with the centerline of a gun muzzle when muzzle break 10 is placed on a gun muzzle. This line segment defines a projectile line 14 running the length of body 20 of muzzle break 10.

Figure 5:
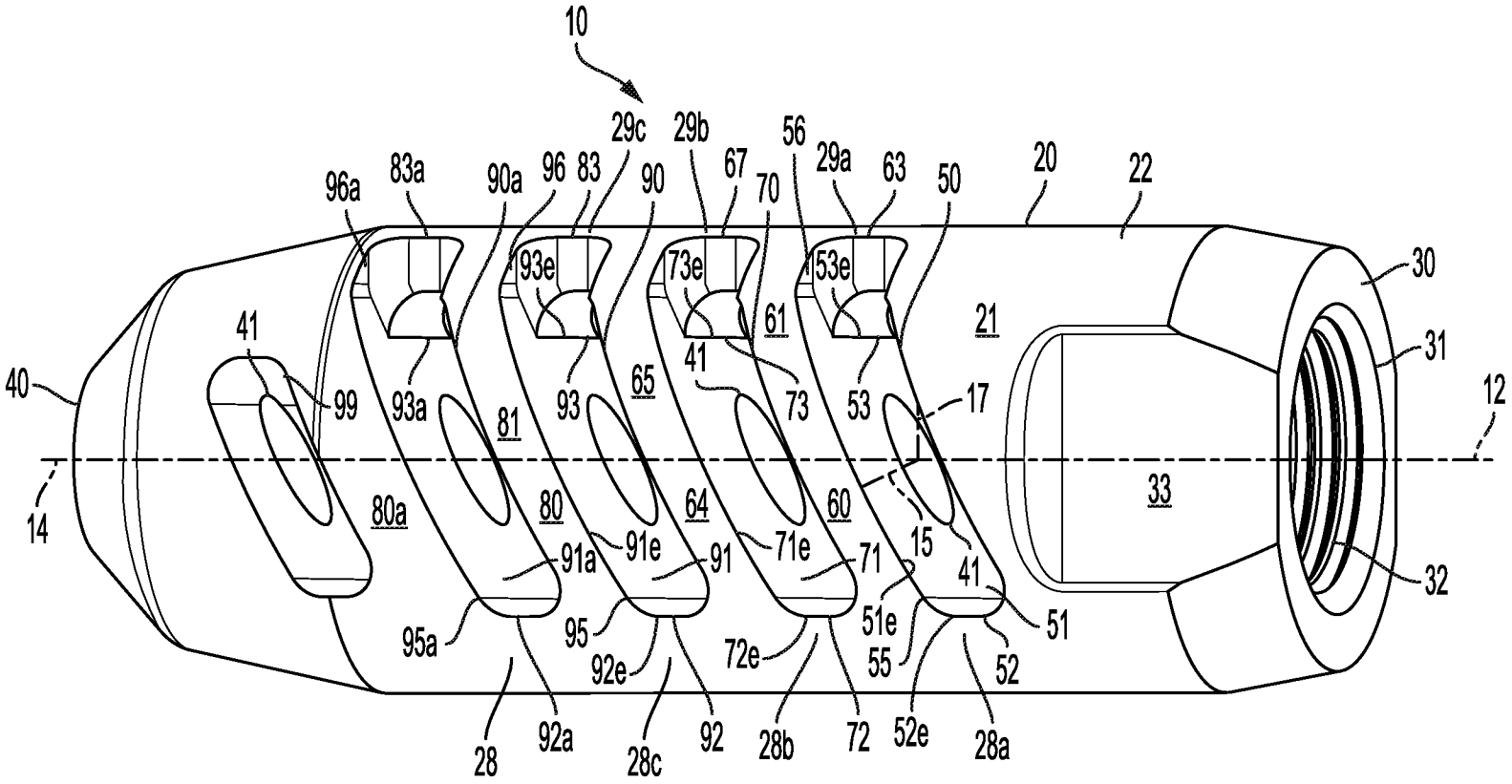
FIG. 5 is a side perspective view of the muzzle brake shown in FIG. 1 from its right end.

Returning to FIG. 1, first compensating aperture 50 passes through body 20 of muzzle brake 10 transverse to body 20 between muzzle end 30 and exit end 40. In geometry, a cylinder is a surface or solid bounded by two parallel planes and generated by a straight line moving parallel to the given planes and tracing a curve bounded by the planes and lying in a plane perpendicular or oblique to the given planes. The curved traced by the generating line need not be a smooth geometric curve, but can include corners, straight lines, arcuate segments, etc. For example, a prism is a cylinder whose cross-section is a polygon. In that sense, first compensating aperture 50 is a cylinder with its generating line 15 perpendicularly intersecting the projectile line 14 when they intersect (see FIG. 5). The (imaginary) parallel planes of the cylinder of first compensating aperture 50 are external to body 20 of muzzle brake 10. First compensating aperture 50 and its surfaces (sides) will have a length dimension along the direction of the generating line of first compensating aperture 50 and a width dimension along the direction of projectile line 14. Additionally, the generating line 15 and projectile line 14 define a plane, which for the purposes of this application is called a compensation plane 16 (see FIGS. 2 and 3). In FIG. 5, a line (indicated at 17) perpendicular to compensation plane 16 through projectile line 14 defines another orthogonal direction along which first compensating aperture 50 and some of its features will have a height dimension. These orthogonal directions also apply to muzzle brake 10 as a whole. The line perpendicular to compensation plane 16 through projectile line 14 also defines another plane, which for purposes of this application is called the plane of symmetry 18. Compensation plane 16 and plane of symmetry 18 are perpendicular to each other and intersect each other in alignment with projectile line 14. Plane of symmetry 18 aligns with the section line shown in FIGS. 2 and 3.

First compensating aperture 50 has a baffle side 51 facing muzzle end 30 of body 20. Containment side 52 of first compensating aperture 50 connects to proximal edge 55 of baffle side 51, and venting side 53 of first compensating aperture 50 connects to distal edge 56 of baffle side 51. In the embodiment shown in FIG. 1, an additional side, passive side 54, connects between containment side 52 and venting side 53 at edge 57 and its opposite edge 58, respectively. In some embodiments of muzzle brake 10, the various sides of first compensating aperture 50 may connect to each other by radiuses, such as radius 59, as shown in FIG. 1, or other transition geometries may be employed. In some embodiments of muzzle break 10, one or more sides of a compensating aperture may themselves be curved. The sides of first compensating aperture 50 have a length dimension along the direction of the generating line of first compensating aperture 50 and a width dimension along the direction of projectile line 14. Some sides also have a height dimension in a direction perpendicular to those first two dimensions.

To the left, first compensating aperture 50 defines first baffle 60 with baffle side 51 of first compensating aperture 50 being the face of baffle 60. To the right, first compensating aperture 50 defines a muzzle section 21 of body 20 (see FIGS. 1 and 5-7). Muzzle section 21 of body 20 has a first end at muzzle end 30 and a second, exit, end terminating at first compensating aperture 50. First baffle 60 is spaced from muzzle section 21 of body by containment side 52 and venting side 53 of first compensating aperture 50. Baffle side 51 of first compensating aperture 50 defines a proximal surface 51 of first baffle 60 facing the second, exit, end of muzzle section 21. Distal surface 74 of first baffle 60 is opposite to proximal surface 51 of first baffle 60. Proximal surface 51 and distal surface 74 of first baffle 60 are connected by side, or sides, 61 of first baffle 60.

In the embodiment of FIG. 1, containment side 52 and venting side 53 are of the same width and proximal edge 55 of baffle side 51 is closer to muzzle end 30 than is distal edge 56 of baffle side 51. This shifts venting side 53 further from muzzle end 30 of body 20 than is containment side 52, and gives first compensating aperture 50 a parallelogram shape with baffle side 51 slanting at an angle from containment side 52 away from muzzle section 30 to venting side 53. This slant of baffle side 51 directs expanding gases toward venting side 53. Venting side 53 is shorter in length than containment side 52. This is more apparent in FIGS. 5-7. Also, venting side 53 is centrally located in body 20, which is most apparent in FIG. 7, which is a top perspective view of the muzzle brake 10 shown in FIG. 1 at an angle aligned with the face of baffle 60 (and other baffles). With venting side 53 being shorter in length than containment side 52, more gases escape at venting side 53, while containment side 52 maintains its full length and presents more surface for the gases to react against. Overall, this produces a force against muzzle brake 10 in the direction of containment side 52. When muzzle brake 10 is properly installed on a firearm, this produces a downward force on the barrel of the firearm.

In the embodiment of muzzle brake 10 shown in FIG. 1, the length of venting side 53 is shortened by notches 63 which pass from first compensating aperture 50 through body 20 out to external of body 20. These notches 63 are at least partially aligned with venting side 53. As noted above, first compensating aperture 50 is in the shape of a geometric cylinder through body 20 of muzzle brake 10. Where the venting side of the cylinder generating first compensating aperture 50 intersects a side of body 20 of muzzle brake 10, notches 63 pass from first compensating aperture 50 out to the external surface of body 20. This shortens the length of venting side 53 as compared to the length of containment side 52. Additionally, in the embodiment of muzzle brake 10, notches 63 are formed such that their sides are directed perpendicularly to compensation plane 16. This further redirects the expanding gases perpendicular to compensation plane 16 and containment side 52 to produce additional downward force to compensate lift of the muzzle.

Returning to FIGS. 2 and 3, which are opposite end views of body 20 of muzzle brake 10, body 20 has a single continuous side 22. While tapering at each end of body 20 (see FIGS. 1 and 4), side 22 is essentially round. In FIG. 2, muzzle aperture 31 has threads 32 for installing muzzle brake 10 onto a respective threaded firearm muzzle. Muzzle aperture 31 extends into body 20 to intersect with first compensating aperture 50, and baffle side 51 of first compensating aperture 50 may be seen through muzzle aperture 31, as well as projectile aperture 41 passing through baffle side 51. Externally, muzzle end 30 of body 20 has opposing flats 33. Flats 33, which may also be seen in FIG. 1, provide a surface for a wrench or similar device to engage which can be used to install muzzle break 10 onto a gun muzzle, or to remove muzzle break 10 from a gun muzzle. FIG. 3 again shows a single continuous side 22 connecting exit end 40 to muzzle end 30. In the embodiment of FIGS. 2 and 3, side 22 is round. However, the single continuous side 22 need not be circular, but may also have other continuously curved shapes, such as elliptical or oval. An elliptical continuous side could provide a wide symmetrical muzzle brake which may provide a shape to take advantage of venting, etc. An oval shaped continuous side could give a wider lower section of body 20, naturally giving containment sides and venting sides of compensating apertures unequal surfaces. Projectile aperture 41 extends into body 20, where it intersects with other apertures in body 20. As projectile aperture 41 is sized and aligned to allow passage of a projectile from a gun, FIG. 3 shows no obstructions in projectile aperture 41 for its length.

Returning to FIG. 4, muzzle aperture 31 extends part way into body 20 of muzzle brake 10 to intersect first compensation aperture 50. Part of muzzle aperture 31 is threaded with threads 32. Muzzle aperture 31 and threads 32 are sized and configured to accommodate a respective muzzle. Exit end 40 has projectile aperture 41 in it. Projectile aperture 41 extends into body 20 of muzzle brake 10 until projectile aperture 41 intersects first compensating aperture 50. In the embodiment of muzzle brake 10 shown in FIG. 4, muzzle aperture 31 and projectile aperture 41 each intersect with first compensating aperture 50. First compensating aperture 50 defines first baffle 60, through which projectile aperture 41 extends. Second compensating aperture 70 defines second baffle 64 through which projectile aperture 41 extends. Then additional compensating apertures 90 and 90*a* each define additional baffles 80 and 80*a*, respectively. A final aperture 99 provides an additional baffle face and gas dissipation.

FIG. 5 is a side perspective view of muzzle brake 10 shown in FIG. 1 from its right end. Muzzle end 30 has muzzle aperture 31, which in FIG. 5 is threaded with threads 32. Flat 33 provides a surface for a wrench or similar tool to engage. In FIG. 5, baffle side 51 of first compensating aperture 50 is visible as is projectile aperture 41 in baffle 60 and baffle side 51. Notch 63 shortens venting side 53 of compensating aperture 50 while containment side 52 extends the full width of body 20 where it intersects side 22. Notch 63 extends upward from the end of side 53 through body 20 to side 22. As may be seen in FIG. 5, the sides of notch 63 are oriented parallel to 17 and perpendicular to compensation plane 16. This further redirects the expanding gases directed to notch 63 by baffle side 51.

The material in body 20 between containment side 52 and side 22 of body 20 forms first bridge section 28*a* from muzzle section 21 to proximal edge 55 of baffle 60. The material in body 20 between venting side 53 and side 22 forms first brace section 29*a* between muzzle section 21 to distal edge 56 of baffle 60. Distal edge 56 of baffle 60 is further from muzzle end 30 of body 20 than is proximal edge 55. First compensating aperture 50, second compensating aperture 70, and additional compensating apertures 90, 90*a*, and 99, define baffles 60, 64, 80, and 80*a*, through each of which projectile aperture 41 passes.

Figure 6:
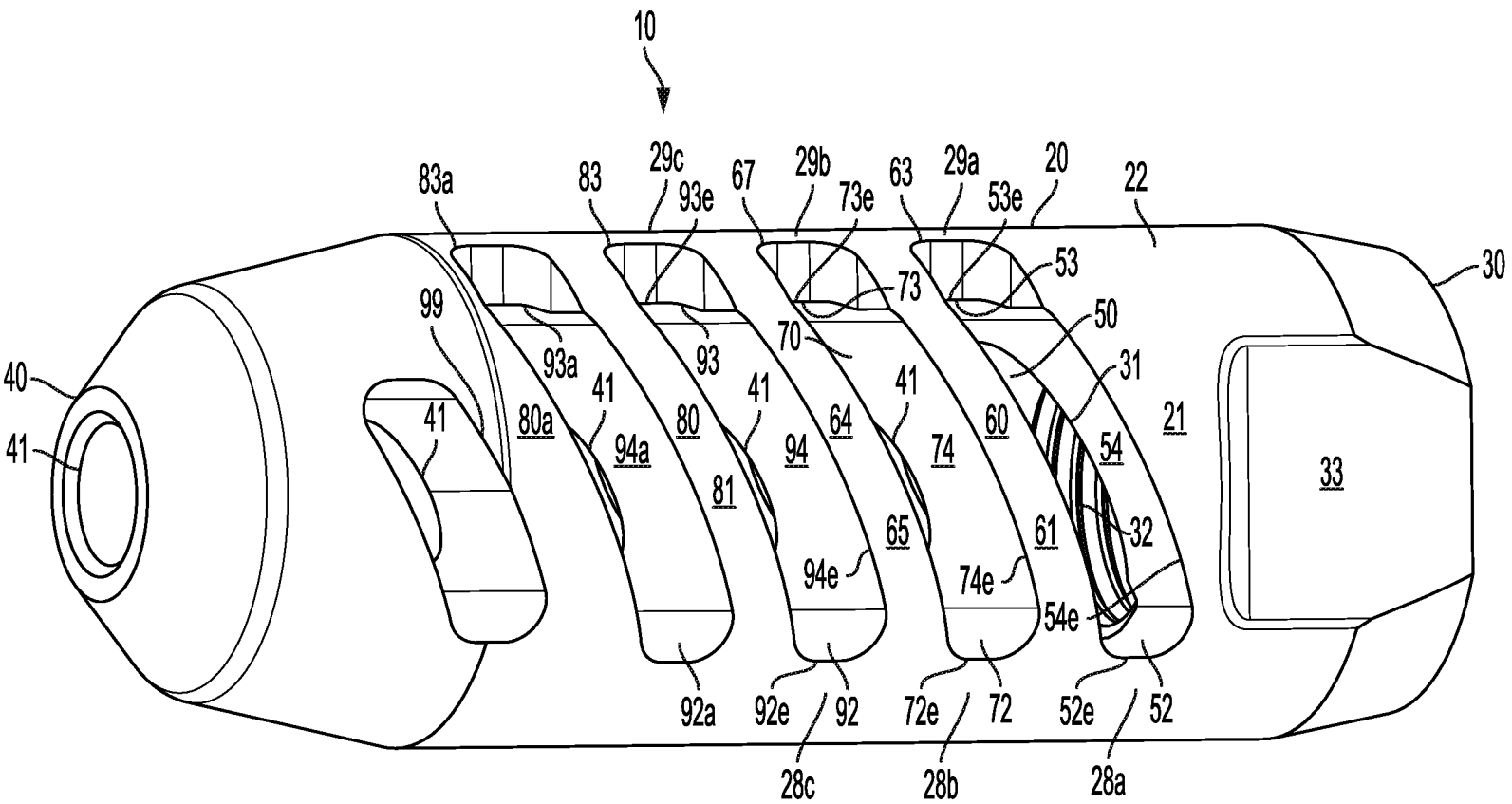
FIG. 6 is a side perspective view of the muzzle brake shown in FIG. 1 from its left end.

FIG. 6 is a side perspective view of muzzle brake 10 shown in FIG. 1 from its left end. Muzzle aperture 31 intersects first compensating aperture 50. Muzzle aperture 31 has threads 32 for attachment to a gun muzzle. Flat 33 provides a surface for a wrench or similar tool to engage. In FIG. 6, the face of passive side 54 of first compensating aperture 50 is visible. Notch 63 shortens venting side 53 of compensating aperture 50 while containment side 52 extends the full width of body 20 where it intersects side 22. Notch 63 extends upward from the end of side 53 through body 20 to side 22. Referring to FIGS. 1 and 5 as well, the material in body 20 between containment side 52 and side 22 of body 20 forms first bridge section 28*a* from muzzle section 21 to proximal edge 55 of baffle 60. The material in body 20 between venting side 53 and side 22 forms first brace section 29*a* between muzzle section 21 to distal edge 56 of baffle 60. Distal edge 56 of baffle 60 is further from muzzle end 30 of body 20 than is proximal edge 55.

Each of the sides of first compensating aperture 50, second compensating aperture 70, and additional compensating aperture 90 have opposing ends. In first compensating aperture 50, end 51*e* of baffle side 51, end 52*e* of containment side 52, and end 53*e* of venting side 53 are more visible in FIG. 5, while end 52*e* of containment side 52, end 53*e* of venting side 53, and end 54*e* of passive side 54 are more visible in FIG. 6. In second compensating aperture 70, end 71*e* of baffle side 71, end 72*e* of containment side 72, and end 73*e* of venting side 73 are more visible in FIG. 5, while end 72*e* of containment side 72, end 73*e* of venting side 73, and end 74*e* of passive side 74 are more visible in FIG. 6. In additional compensating aperture 90, end 91*e* of baffle side 91, end 92*e* of containment side 92, and end 93*e* of venting side 93 are more visible in FIG. 5, while end 92*e* of containment side 92, end 93*e* of venting side 93, and end 94*e* of passive side 94 are more visible in FIG. 6.

Figure 7:
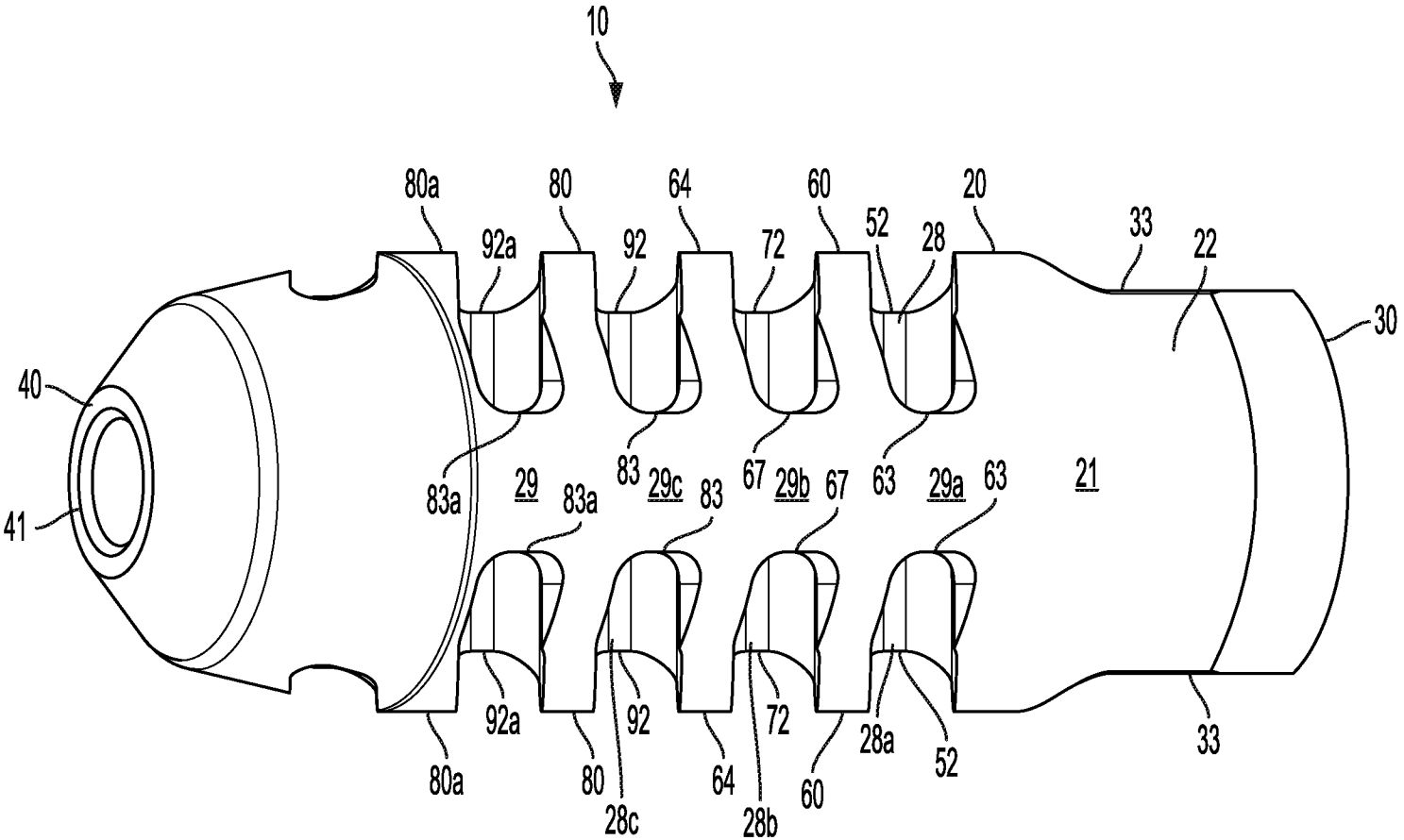
FIG. 7 is a top perspective view of the muzzle brake shown in FIG. 1 at an angle aligned with the face of the baffles.

FIG. 7 is a top perspective view of the muzzle brake shown in FIG. 1 at an angle aligned with the face of the baffle 60 (and other baffles). Containment side 52 is the top surface of first bridge section 28*a*. Referring back to FIG. 1, matching notches 63 cut into body 20 generally in alignment with venting side 53 of first compensating aperture 20. This shortens venting side 53 which is beneath first brace section 29*a*, such that containment side 52 and first bridge section 28*a* (see FIGS. 1, 5 & 6) beneath containment side 52 are wider than first brace section 29*a* and venting side 53 (see FIGS. 1, 5, & 6) beneath first brace section 29*a*. In FIG. 7, containment side 52 and first bridge section 28*a* beneath it, of which containment side 52 is the top surface, may be seen extending past both sides of first brace section 29*a* with venting side 53 beneath it. Venting side 53 is beneath first brace section 29*a* and is not visible in FIG. 7 (see FIGS. 1, 5, & 6). This produces more surface at containment side 52 for gases to react against than is presented by venting side 53. When muzzle brake 10 is properly aligned on a firearm muzzle, the greater reaction against containment side 52 of first compensation aperture 50 creates a force downward on muzzle brake 10 and the respective firearm. The downward force compensates against the tendency of the muzzle to rise.

Some embodiments of muzzle brake 10 may have more than one compensating aperture through body 20. Returning to FIG. 1, second compensating aperture 70 and additional compensating apertures 90 and 90*a* are each cylinder apertures through body 20 of muzzle brake 10. For each of these apertures, their generating lines are parallel to the generating line of first compensating aperture 50. Their generating lines will also be perpendicular to projectile line 14 where they intersect with projectile line 14. This aligns each of these compensating apertures to first compensating aperture 50 and their length dimensions and width dimension are in the same orientation. Body 20 extends bridge 28 from baffle 60 to connect to the proximal edges of baffles 64, 80, and 80*a* and extends brace 29 from baffle 60 to connect to the distal edges of baffles 64, 80 and 80*a*.

Second compensating aperture 70 has baffle side 71 and defines an associated baffle, second baffle 64. Containing side 72 and venting side 73 are associated with proximal edge 75 and distal edge 76, respectively, of baffle side 71 of second compensating aperture 70. In the embodiment shown in FIG. 1, an additional side, passive side 74, connects between containment side 72 and venting side 73 at edge 77 and its opposite edge 78, respectively. In some embodiments of muzzle brake 10, the various sides of first compensating aperture 70 may connect to each other by radiuses, such as radius 79, as shown in FIG. 1, or other transition geometries may be employed. Referring to FIGS. 1, and 5-7, notches 67 in body 20 are aligned with venting side 73 of second compensating aperture 70. Notches 67 reduce the length of venting side 73 as compared to containing side 72 of compensating aperture 70. The sides of notches 67 are oriented perpendicular to compensation plane 16 to further redirect expanding gases directed to notches 67 by baffle side 71. As may be seen especially in FIG. 7, containing side 72 extends past both sides of brace 29 (and beyond the ends of opposing venting side 73 beneath brace 29, which is not visible in FIG. 7, see FIGS. 1, 5 & 6). The surfaces of containing side 72 visible to each side of brace 29 provide more surface area than is presented by venting side 73 for the propelling gases to react against as they expand. Since second compensating aperture 70 and its individual features align with first compensating aperture 50, this adds to the compensating force produced by first compensating aperture 50. Baffle side 71 of second compensating aperture 70 defines a proximal surface 71 of second baffle 64 facing distal surface 74 of first baffle 60 and directed toward the second, exit, end of muzzle section 21. Distal surface 94 of second baffle 64 is opposite to proximal surface 71 of second baffle 64. Proximal surface 71 and distal surface 94 of second baffle 60 are connected by side, or sides, 65 of second baffle 64. A second bridge section 28*b* extends bridge 28 from first baffle 60 to second baffle 64, and a second brace section 29*b* extends brace 29 from first baffle 60 to second baffle 64.

Additional compensating apertures 90 and 90*a*, seen in FIGS. 1, and 4-7, function much as first compensating aperture 50 and second compensating aperture 70. Additional compensating apertures 90 and 90*a* have baffle sides 91 and 91*a*, respectively, and define associated baffles 80 and 80*a*, respectively. Baffle sides 91 and 91*a* are associated with proximal edges 95 and 95*a*, respectively, of baffle sides 91 and 91*a*, respectively. Venting sides 93 and 93*a* are associated with distal edges 96 and 96*a* respectively of baffle sides 91 and 91*a*, respectively. In the embodiment shown in FIG. 1, an additional side, passive side 94, connects between containment side 92 and venting side 93 at edge 97 and its opposite edge 98, respectively. Similarly, passive side 94*a* of aperture 90*a* connects between containment side 92*a* and venting side 93*a*. Referring to FIGS. 1, and 5-7, notches 83 and 83*a* in body 20 are aligned with venting side 93 and 93*a* respectively. Notches 83 and 83*a* reduce the lengths of venting sides 93 and 93*a*, respectively, as compared to containing sides 92 and 92*a*. The sides of notches 83 and 83*a* are oriented perpendicular to compensation plane 16 to further redirect expanding gases directed to notches 83 and 83*a* by baffle sides 91 and 91*a* respectively. As may be seen especially in FIG. 7, containing sides 92 and 92*a* extend past both sides of brace 29 (and beyond the ends of venting sides 93 and 93*a* beneath brace 29, which are not visible in FIG. 7). The surfaces of containing sides 92 and 92*a* visible to each side of brace 29 provide more surface area than is presented by venting sides 93 and 93*a* for the propelling gases to react against as they expand. Since additional compensating apertures 90 and 90*a* and their individual features align with first compensating aperture 50 and second compensating aperture 70, this adds to the compensating force produced by first compensating aperture 50 and second compensating aperture 70. As may be seen in FIG. 7, brace 29 provides a centered connection running the between the baffles. Thus, when muzzle brake 10 is properly installed on a firearm, brace 29 diverts the expanding gases from the line of sight along the top of the barrel.

In some embodiments, muzzle brake 10 has a plurality of additional baffles in addition to its first baffle, first baffle 50. Referring to FIGS. 1, 5, 6, and 7, compensating apertures 70 and 90 separate additional baffles 64 and 80 respectively. Baffles 64 and 80 each have proximal surfaces 71 and 91, respectively, and distal surfaces 94 and 94*a*, respectively. Each of the proximal and distal surfaces of baffles 64 and 80, 71 and 94 and 91 and 94*a* respectively are connected by at least one side, 65 and 81 of their respective baffles. An additional bridge section, second bridge section 28*b* extends bridge 28 to baffle 64, and an additional brace section, second brace section 29*b* extends brace 29 to baffle 64. An additional bridge section, bridge section 28*c* extends bridge 28 to baffle 80, and an additional brace section, brace section 29*c* extends brace 29 to baffle 80.

Final aperture 99 passes through body 20 and allows additional dissipation of propellant gases before exit end 40. In this embodiment, body 20 is not notched at this final compensating aperture 99. Although the embodiment of muzzle brake 10 shown in FIG. 1, has five apertures passing transversely through body 20, more or fewer apertures could be employed in other embodiments. Additionally, the apertures 50, 70, 90, 90*a* and 99 are symmetrical. Other embodiments may have at least one asymmetrical aperture through body 20.

Referring now back to FIG. 5, the intersection of projectile line 14 and generating line 15 define compensation plane 16. Line segment 17 can be considered to define a positive direction with respect to compensation plane 16 while the opposite direction may be considered a negative direction. When muzzle brake 10 is installed on a muzzle in the correct orientation, line segment 17 will point in the up direction. Referring now to FIG. 1, each differential sliver of the surface of the compensating apertures will face in a direction above compensation plane 16, i.e. in a positive direction, a direction below compensation plane 16, i.e. in a negative direction, or a direction parallel to compensation plane 16, i.e. a neutral direction. In the embodiments of muzzle brake 10 shown in FIGS. 1-7, the compensating apertures each have more surface area facing in a positive direction than they have facing in a negative direction. In the embodiments of FIGS. 1-7, this is accomplished by notching body 20 in alignment with the compensating apertures. This is seen most clearly in FIGS. 5-7.

Figure 8:
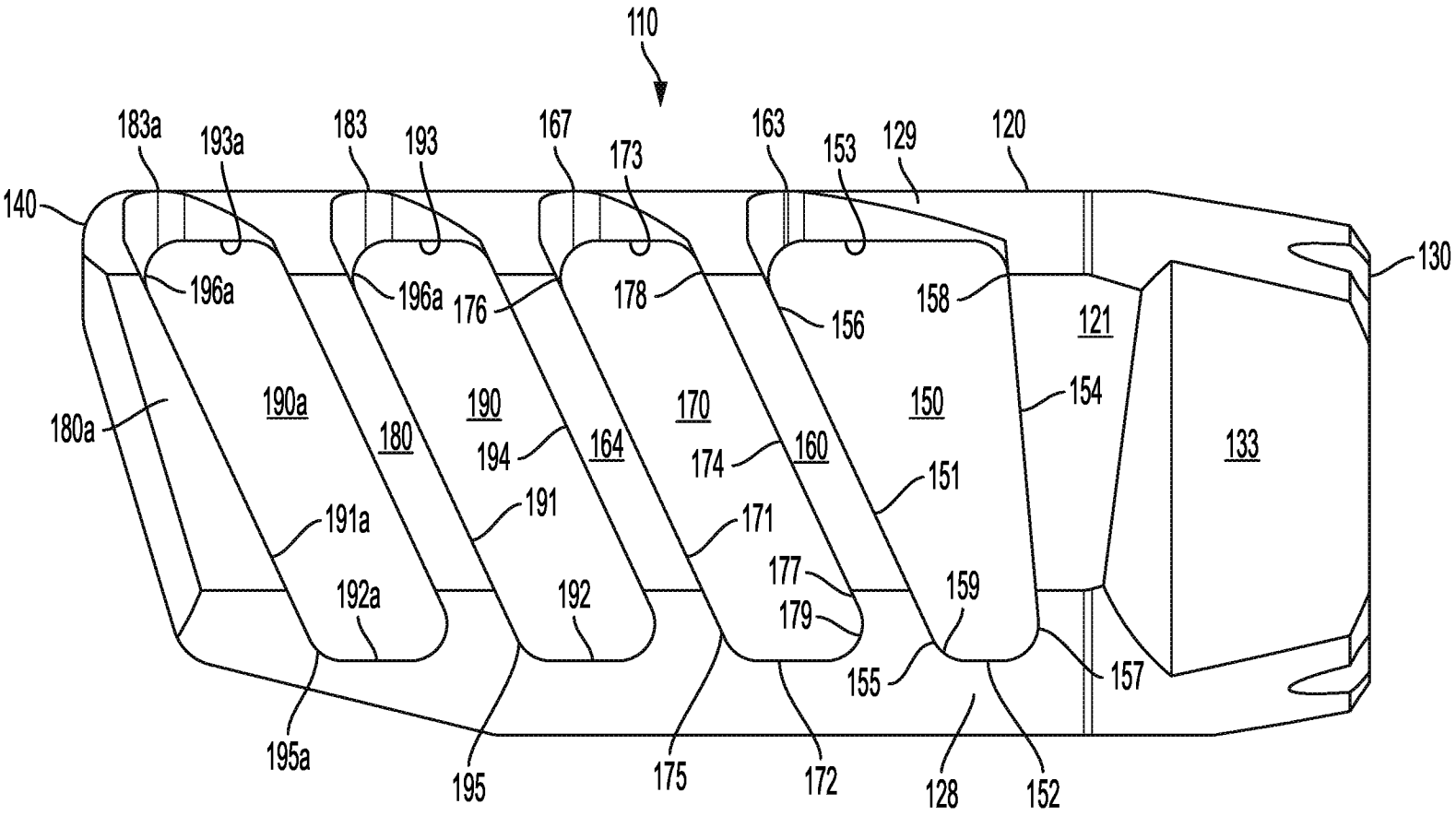
FIG. 8 is a side view of another embodiment of a muzzle brake of the present invention.
Figure 9:
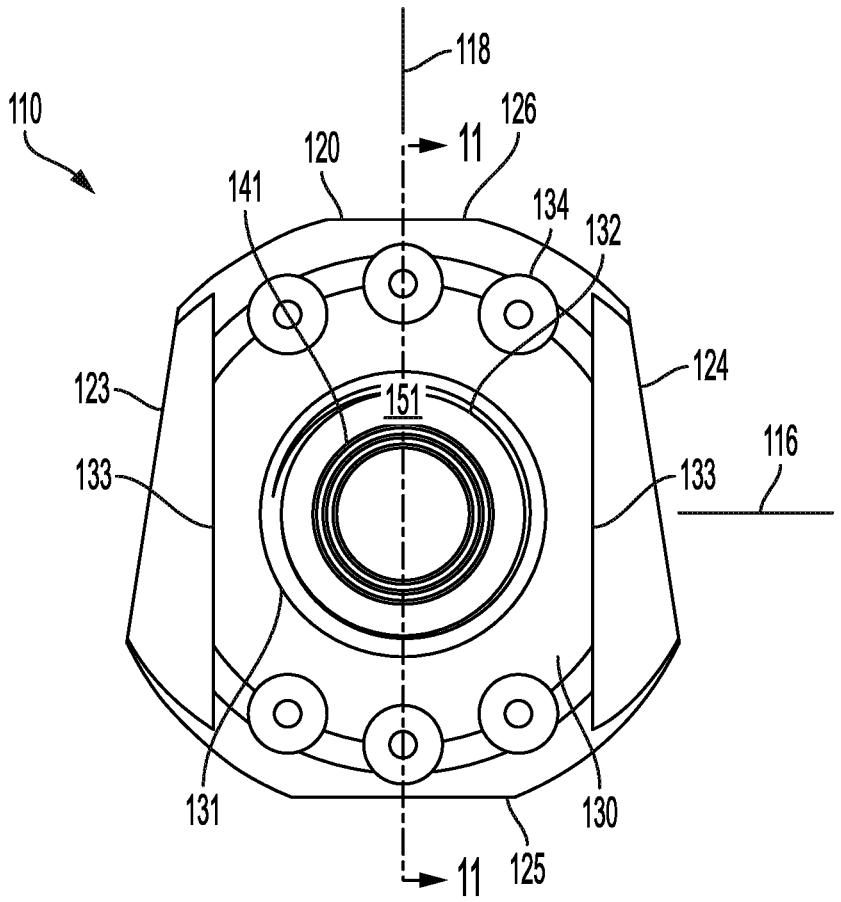
FIG. 9 is a right end view of the embodiment of the muzzle brake shown in FIG. 8.
Figure 10:
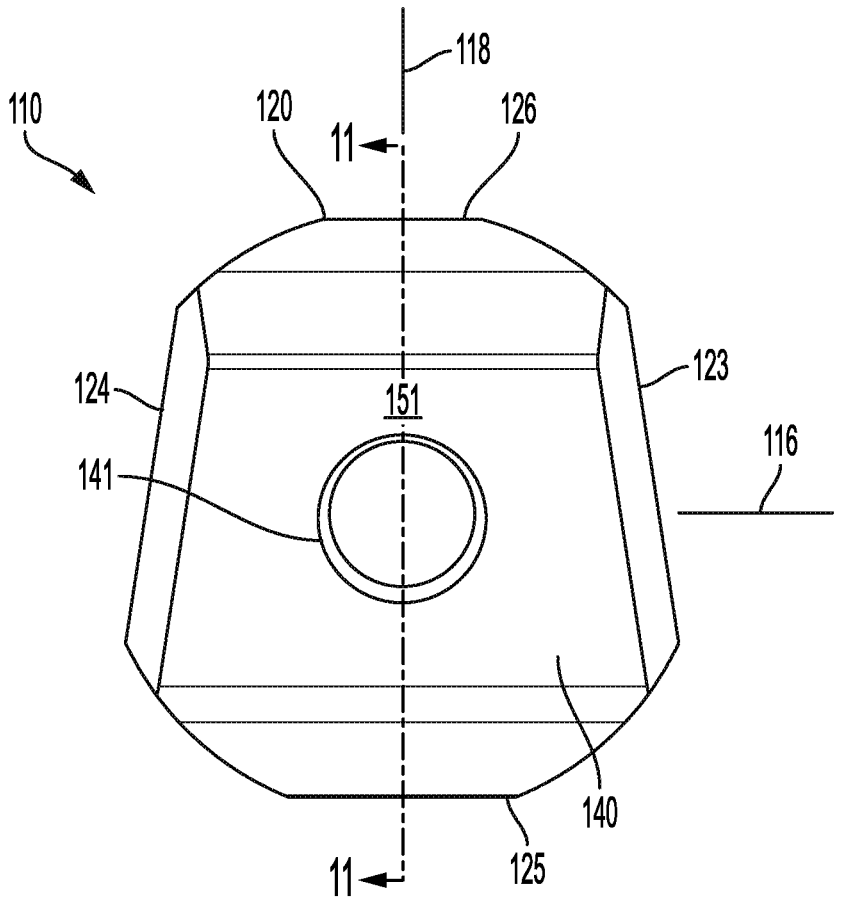
FIG. 10 is a left end view of the embodiment of the muzzle brake shown in FIG. 8.
Figure 11:
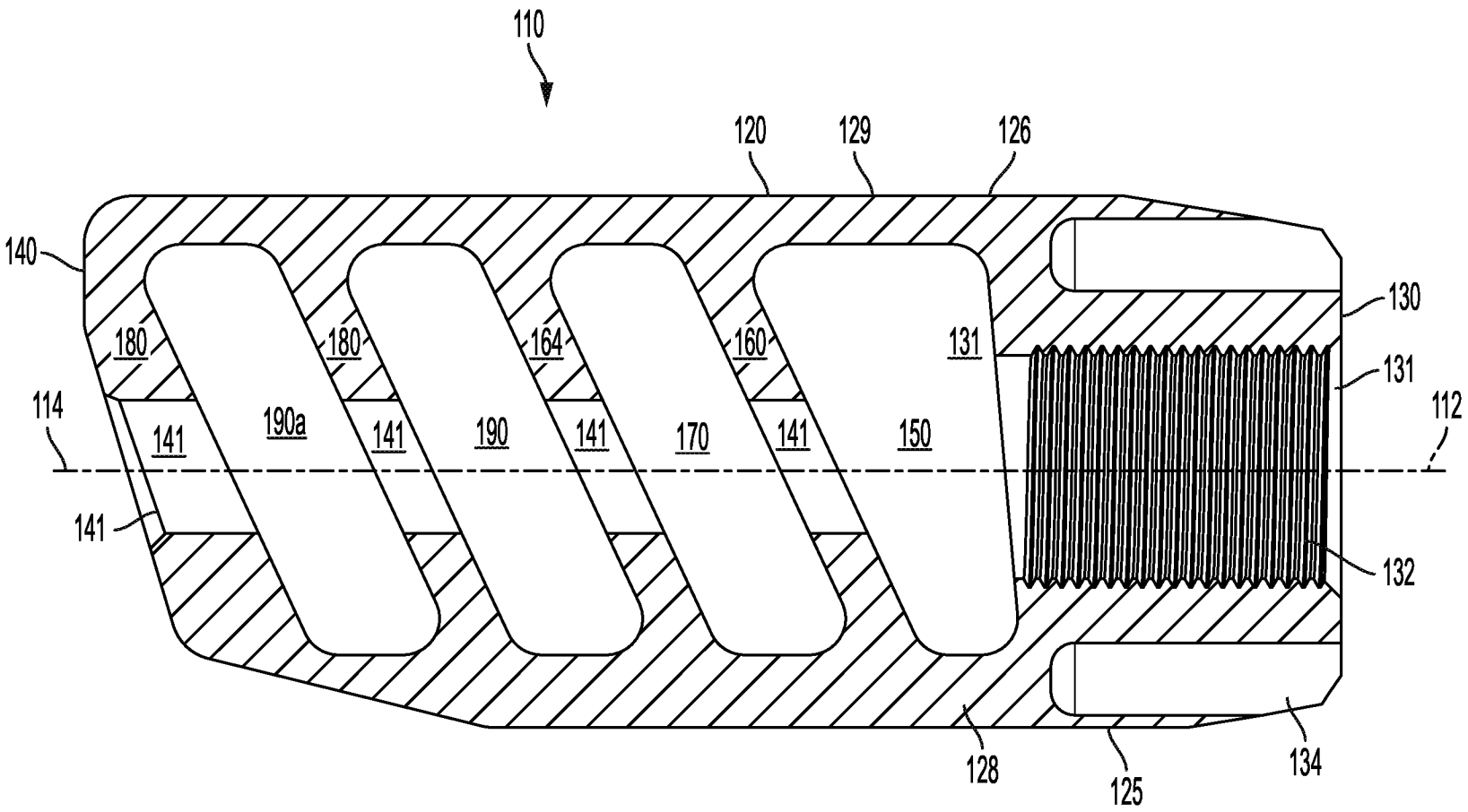
FIG. 11 is a section view of the embodiment of the muzzle brake shown in FIG. 8 along the lines shown in FIGS. 9 and 10.

FIG. 8 is a side view of another embodiment of a muzzle brake 110 of the present invention, and similar identification numbers will be used for similar elements. Muzzle brake 110 has a body 120 with a first, muzzle, end 130 and a second, exit, end 140. FIG. 9 is a right end view of the embodiment of the muzzle brake 110 shown in FIG. 8. In FIG. 9, muzzle aperture 131 in muzzle end 130 is configured and sized to fit a gun muzzle and to allow passage of a projectile from the gun muzzle. FIG. 10 is a left end view of the embodiment of muzzle brake 110 shown in FIG. 8. In FIG. 10, projectile aperture 141 in exit end 140 is sized to allow passage of a projectile from the gun muzzle. Projectile aperture 141 is also deep enough to intersect muzzle aperture 131 and sufficiently aligned with muzzle aperture 131 to allow passage of a projectile from the gun muzzle. Both FIGS. 9 and 10 show that body 120 has a plurality of sides connecting muzzle end 130 and exit end 140. FIG. 11 is a section view of the embodiment of muzzle brake 110 shown in FIG. 8 along the lines shown in FIGS. 9 and 10. In FIG. 11, muzzle aperture 131 and projectile aperture 141 may be seen intersecting each other and in alignment. A line segment 112 within the space of muzzle aperture 131 will align with the centerline of a gun muzzle when muzzle break 110 is placed on a gun muzzle. This line segment defines a projectile line 114 running the length of body 120 of muzzle break 110.

Returning to FIG. 8, first compensating aperture 150 passes through body 120 of muzzle brake 110 transverse to body 120 between muzzle end 130 and exit end 140. In geometry, a cylinder is a surface or solid bounded by two parallel planes and generated by a straight line moving parallel to the given planes and tracing a curve bounded by the planes and lying in a plane perpendicular or oblique to the given planes. In that sense, first compensating aperture 150 is a cylinder with its generating line perpendicularly intersecting the projectile line 114 when they intersect (see FIG. 12). The (imaginary) parallel planes of the cylinder of first compensating aperture 150 are external to body 120 of muzzle brake 110. First compensating aperture 150 and its surfaces (sides) will have a length dimension along the direction of the generating line of first compensating aperture 150 and a width dimension along the direction of projectile line 114. Additionally, the generating line and projectile line 114 define a plane, which for the purposes of this application is called a compensation plane 116. A line (indicated at 117) perpendicular to compensation plane 116 through projectile line 14 defines another orthogonal direction along which first compensating aperture 150 and some of its features will have a height dimension. These orthogonal directions also apply to muzzle brake 110 as a whole. The line perpendicular to compensation plane 116 through projectile line 114 also defines another plane, which for purposes of this application is called the plane of symmetry 118. Compensation plane 116 and plane of symmetry 118 are perpendicular to each other and intersect each other in alignment with projectile line 114. Plane of symmetry 118 aligns with the section line shown in FIGS. 9 and 10.

First compensating aperture 150 has a baffle side 151 facing muzzle end 130 of body 120. Containment side 152 of first compensating aperture 150 connects to proximal edge 155 of baffle side 151, and venting side 153 of first compensating aperture 150 connects to distal edge 156 of baffle side 151. In the embodiment shown in FIG. 8, an additional side, passive side 154, connects between containment side 152 and venting side 153 at edge 157 and its opposite edge 158, respectively. In some embodiments of muzzle brake 110, the various sides of first compensating aperture 150 may connect to each other by radiuses, such as radius 159, as shown in FIG. 8, or other transition geometries may be employed. In some embodiments of muzzle break 110, one or more sides of a compensating aperture may themselves be curved. The sides of first compensating aperture 150 have a length dimension along the direction of the generating line of first compensating aperture 150 and a width dimension along the direction of projectile line 114.

To the left, first compensating aperture 150 defines first baffle 160 with baffle side 151 of first compensating aperture 150 being the face of baffle 160. To the right, first compensating aperture 150 defines a muzzle section 121 of body 120. Muzzle section 121 of body 120 has a first end at muzzle end 130 and a second end terminating at first compensating aperture 150. First baffle 160 is spaced from muzzle section 121 of body by containment side 152 and venting side 153 of first compensating aperture 150.

In the embodiment of FIG. 8, containment side 152 and venting side 153 are of the same width and proximal edge 155 of baffle side 151 is closer to muzzle end 130 than is distal edge 56 of baffle side 51. This shifts venting side 153 further from muzzle end 130 of body 120 than is containment side 152, and gives first compensating aperture 150 a parallelogram shape with baffle side 151 slanting at an angle from containment side 152 away from muzzle section 130 to venting side 153. This slant of baffle side 151 directs expanding gases toward venting side 153. Venting side 153 is shorter in length than containment side 152. This is more apparent in FIGS. 12-14. Also, venting side 153 is centrally located in body 120, which is most apparent in FIG. 14, which is a top perspective view of muzzle brake 110 shown in FIG. 8 at an angle aligned with the face of baffle 160 (and other baffles). With venting side 153 being shorter in length than containment side 152, more gases escape at venting side 153, while containment side 152 maintains its full length and presents more surface for the gases to react against. Overall, this produces a force against muzzle brake 110 in the direction of containment side 152. When muzzle brake 110 is properly installed on a firearm, this produces a downward force on the barrel of the firearm.

In the embodiment of muzzle brake 110 shown in FIG. 8, the length of venting side 153 is shortened by notches 163 which pass from first compensating aperture 150 through body 120 out to external of body 120. These notches 163 are at least partially aligned with venting side 153. As noted above, first compensating aperture 150 is in the shape of a geometric cylinder through body 120 of muzzle brake 110. Where the venting side of the cylinder generating first compensating aperture 150 intersects a side of body 120 of muzzle brake 110, notches 163 pass from first compensating aperture 150 out to the external surface of body 120. This shortens the length of venting side 153 as compared to the length of containment side 152.

Returning to FIGS. 9 and 10, which are opposite end views of body 120 of muzzle brake 110, body 120 has a plurality of sides connecting muzzle end 130 and exit 140 of body 120. Body 120 is symmetrical across plane of symmetry 118 with tapered sides 123 and 124 being the predominant sides to each side of plane of symmetry 118. Tapered sides 123 and 124 give body 120 greater width below compensation plane 116, and body 120 is reduced in width above compensation plane 116. Closed side 125 beneath compensation plane 116 is opposed by reduced side 126 above compensation plane 116. Reflecting the taper of tapered sides 123 and 124, reduced side 126 is shorter than closed side 125 along the direction of the generating line of first compensating aperture 150. This difference in dimension naturally gives containment sides and venting sides of compensating apertures unequal surfaces. Just with the introduction of apertures through tapered sides 123 and 124, the venting sides expose more surface area of the containment sides and more gas forces are exerted against the containment sides. This by itself provides some of the compensating effect of muzzle brake 10 against the tendency of a firearm to rise.

In FIG. 9, muzzle aperture 131 has threads 132 for installing muzzle brake 110 onto a respective threaded firearm muzzle. Muzzle aperture 131 extends into body 120 to intersect with first compensating aperture 150, and baffle side 151 of first compensating aperture 150 may be seen through muzzle aperture 131, as well as projectile aperture 141 passing through baffle side 151. Externally, muzzle end 130 of body 120 has opposing flats 133. Flats 133, which may also be seen in FIG. 8, provide a surface for a wrench or similar tool to engage which can be used to install muzzle break 110 onto a gun muzzle, or to remove muzzle break 110 from a gun muzzle. Lightening holes 134 around muzzle aperture 131 remove material from body 120 of muzzle brake 110 to lighten muzzle brake 110. In FIG. 10. projectile aperture 141 extends into body 120, where it intersects with other apertures in body 120. As projectile aperture 141 is sized and aligned to allow passage of a projectile from a gun, FIG. 10 shows no obstructions in projectile aperture 141 for its length.

Figure 12:
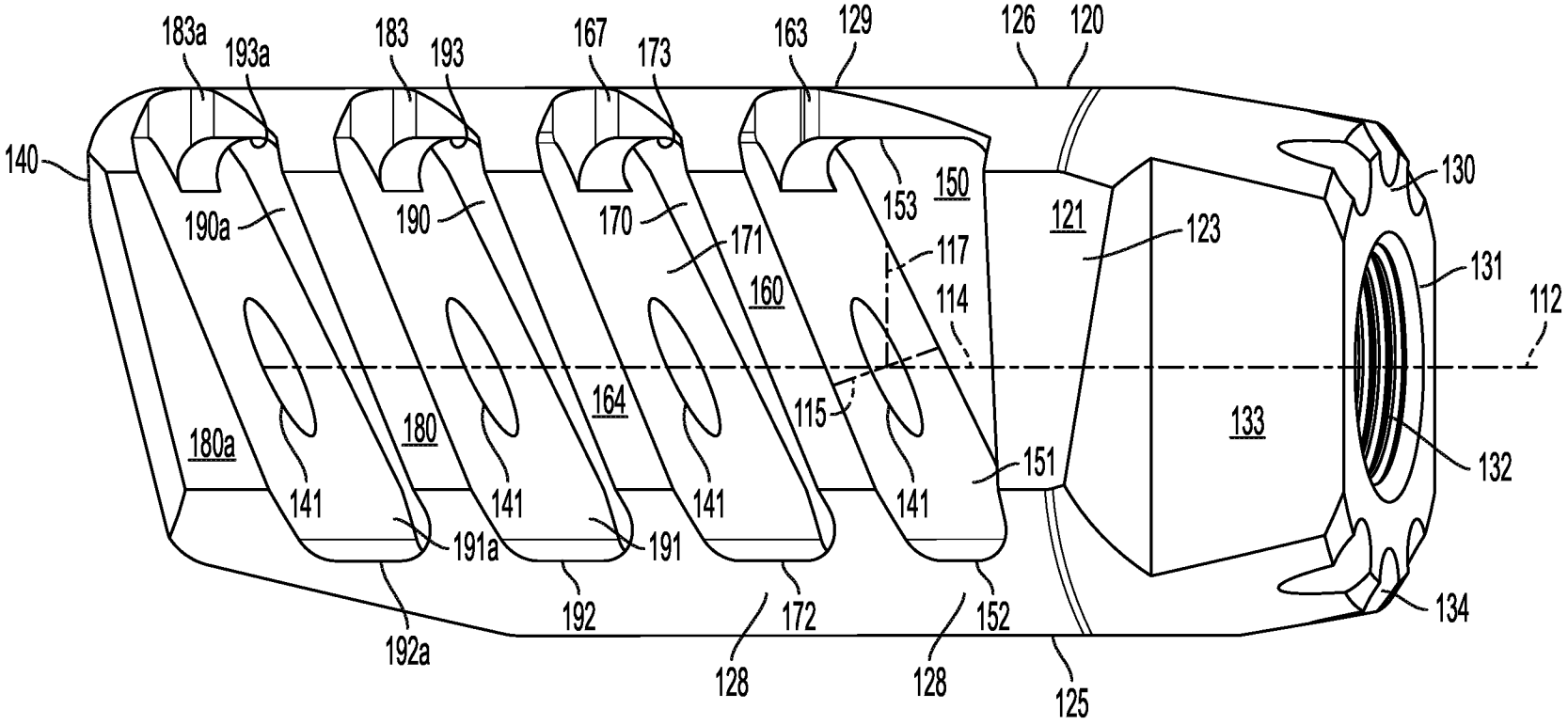
FIG. 12 is a side perspective view of the muzzle brake shown in FIG. 8 from its right end.

FIG. 12 is a side perspective view of muzzle brake 110 shown in FIG. 8 from its right end. Muzzle end 130 has muzzle aperture 131, which in FIG. 12 is threaded with threads 132. Flat 133 provides a surface for a wrench or similar tool to engage. In FIG. 12, baffle side 151 of first compensating aperture 150 is visible as is projectile aperture 141 through baffle 160 and baffle side 151. Notch 163 further shortens venting side 153 of compensating aperture 150 while containment side 152 extends the full width of body 120 where it intersects the surface of body 120. Notch 163 extends upward from the end of side 153 through body 120 to side 126. The material in body 120 between containment side 152 and side 126 of body 120 forms bridge 128 from muzzle section 121 to proximal edge 155 of baffle 160. The material in body 120 between venting side 153 and side 126 forms brace 129 between muzzle section 121 to distal edge 156 of baffle 160. Distal edge 156 of baffle 160 is further from muzzle end 130 of body 120 than is proximal edge 155. First compensating aperture 150, second compensating aperture 170, and additional compensating apertures 190, and 190*a* define baffles 160, 164, 180, and 180*a*, through each of which projectile aperture 141 passes.

Figure 13:
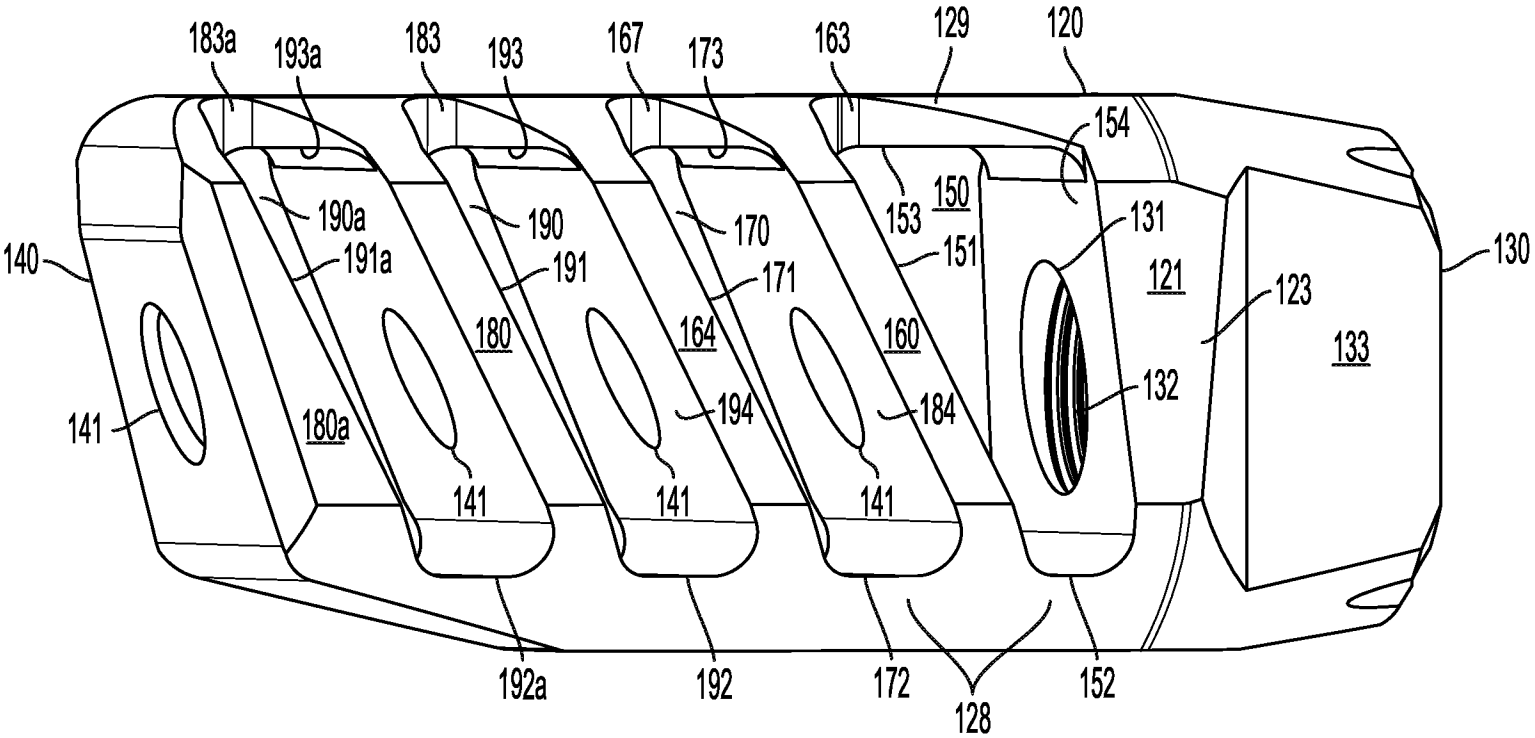
FIG. 13 is a side perspective view of the muzzle brake shown in FIG. 8 from its left end.

FIG. 13 is a side perspective view of muzzle brake 110 shown in FIG. 8 from its left end. Muzzle aperture 131 intersects first compensating aperture 150. Muzzle aperture 131 has threads 132 for attachment to a gun muzzle. Flat 133 provides a surface for a wrench or similar tool to engage. In FIG. 13, passive side 154 is visible opposite to baffle side 151 of first compensating aperture 150. Notch 163 further reduces venting side 153 of compensating aperture 150 while containment side 152 extends the full width of body 120 where it intersects the surface of body 120. Notch 163 extends upward from the end of side 153 through body 120 to side 126. The material in body 120 between containment side 152 and side 126 of body 120 forms bridge 128 from muzzle section 121 to proximal edge 155 of baffle 160. The material in body 120 between venting side 153 and side 126 forms brace 129 between muzzle section 121 to distal edge 156 of baffle 160. Distal edge 156 of baffle 160 is further from muzzle end 130 of body 120 than is proximal edge 155.

Figure 14:
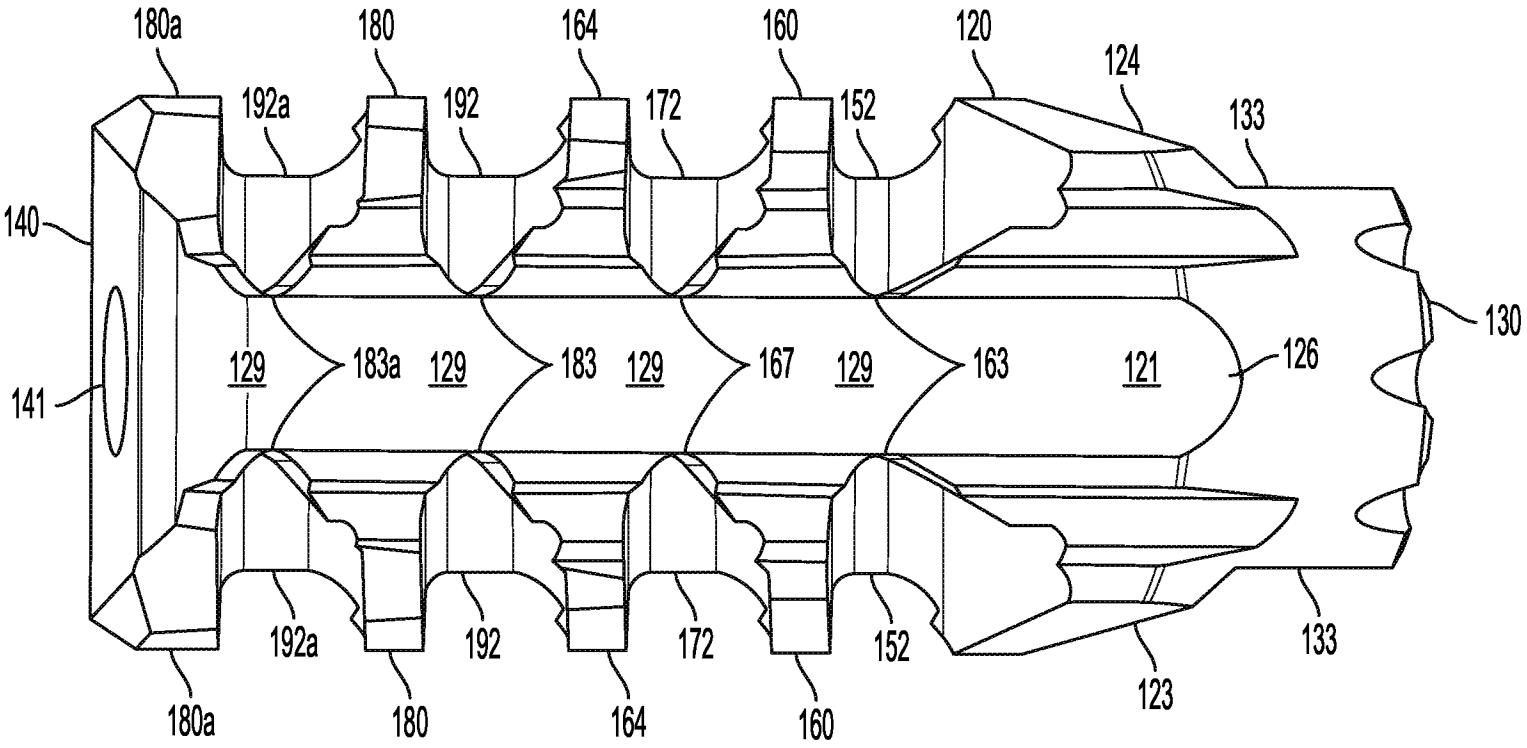
FIG. 14 is a top perspective view of the muzzle brake shown in FIG. 8 at an angle aligned with the face of the baffles.

FIG. 14 is a top perspective view of muzzle brake 110 shown in FIG. 8 at an angle aligned with the face of the baffle 160 (and other baffles). In FIG. 14, matching notches 163 cut into body 120 generally in alignment with venting side 153 of first compensating aperture 120. This further reduces venting side 153 which is beneath brace 129, such that containment side 152 and bridge 128 beneath containment side 152 are wider than brace 129 and venting side 153 beneath brace 129. In FIG. 14, containment side 152 and bridge 128 beneath it may be seen extending past both sides of brace 129 with venting side 153 beneath it. This produces more surface at containment side 152 for gases to react against than is presented by venting side 153. When muzzle brake 110 is properly aligned on a firearm muzzle, the greater reaction against containment side 152 of first compensation aperture 150 creates a force downward on muzzle brake 110 and the respective firearm. The downward force compensates against the tendency of the muzzle to rise.

Some embodiments of muzzle brake 110 may have more than one compensating aperture through body 120. Returning to FIG. 8, second compensating aperture 170 and additional compensating apertures 190 and 190*a* are each cylinder apertures through body 120 of muzzle brake 110. For each of these apertures, their generating lines are parallel to the generating line of first compensating aperture 150. Their generating lines will also be perpendicular to projectile line 114 where they intersect with projectile line 114. This aligns each of these compensating apertures to first compensating aperture 150 and their length dimensions and width dimension are in the same orientation. Body 120 extends bridge 128 from baffle 160 to connect to the proximal edges of baffles 164, 180, and 180*a* and extends brace 129 from baffle 160 to connect to the distal edges of baffles 164, 180 and 180*a*.

Second compensating aperture 170 has baffle side 171 and defines associated baffle 164. Containment side 172 and venting side 173 are associated with proximal edge 175 and distal edge 176, respectively, of baffle side 171 of second compensating aperture 170. Passive side 174 connects to containment side 172 and venting side 173 at its proximal edge 177 and its distal edge 178 respectively. The edges may connect directly or there may be a curved transition, such as at radius 179. In some cases, one or more sides of aperture 170 may be curved. Referring to FIGS. 8, 12, 13, and 14, notches 167 in body 120 are aligned with venting side 173 of second compensating aperture 170. Notches 167 reduce venting side 173 as compared to containing side 172 of compensating aperture 170. As may be seen especially in FIG. 14, containing side 172 extends past both sides of brace 129 (and beyond the ends of opposing venting side 173 beneath brace 129). The surfaces of containing side 172 visible to each side of brace 129 provide more surface area than is presented by venting side 173 for the propelling gases to react against as they expand. Since second compensating aperture 170 and its individual features align with first compensating aperture 150, this adds to the compensating force produced by first compensating aperture 150.

Additional compensating apertures 190 and 190*a*, seen in FIGS. 8, and 4-7, function much as first compensating aperture 150 and second compensating aperture 170. Additional compensating apertures 190 and 190*a* have baffle sides 191 and 191*a*, respectively, and define associated baffles 180 and 180*a*, respectively. Baffle sides 191 and 191*a* are associated with proximal edges 195 and 195*a*, respectively, of baffle sides 191 and 191*a*, respectively. Venting sides 193 and 193*a* are associated with distal edges 196 and 196*a* respectively of baffle sides 191 and 191*a*, respectively. Referring to FIGS. 1, and 5-7, notches 183 and 183*a* in body 120 are aligned with venting side 193 and 193*a* respectively. Notches 183 and 183*a* reduce venting sides 193 and 193*a*, respectively, as compared to containing sides 192 and 192*a*. As may be seen especially in FIG. 14, containing sides 192 and 192*a* extend past both sides of brace 129 (and beyond the ends of venting sides 193 and 193*a* beneath brace 129). The surfaces of containing sides 192 and 192*a* visible to each side of brace 129 provide more surface area than is presented by venting sides 193 and 193*a* for the propelling gases to react against as they expand. Since additional compensating apertures 190 and 190*a* and their individual features align with first compensating aperture 150 and second compensating aperture 170, this adds to the compensating force produced by first compensating aperture 150 and second compensating aperture 170. Although the embodiment of muzzle brake 110 shown in FIG. 8, has four apertures passing transversely through body 120, more or fewer apertures could be employed in other embodiments. As may be seen in FIG. 14, brace 129 provides a centered connection running the between the baffles. Thus, when muzzle brake 110 is properly installed on a firearm, brace 129 diverts the expanding gases from the line of sight along the top of the barrel.

Referring now back to FIG. 12, the intersection of projectile line 114 and generating line 115 define compensation plane 116. Line segment 117 can be considered to define a positive direction with respect to compensation plane 116, while the opposite direction may be considered a negative direction. When muzzle brake 110 is installed on a muzzle in the correct orientation, line segment 117 will point in the up direction. Referring now to FIG. 8, each differential sliver of the surface of the compensating apertures will face in a direction above compensation plane 116, i.e. in a positive direction, a direction below compensation plane 116, i.e. in a negative direction, or a direction parallel to compensation plane 116, i.e. a neutral direction. In first compensating aperture 150, passive side 154 has a substantial portion of its surface facing in a direction parallel to compensation plane 116. In the embodiments of muzzle brake 110 shown in FIGS. 8-14, the compensating apertures each have more surface area facing in a positive direction than they have facing in a negative direction. In the embodiments of FIGS. 8-14, this is accomplished in two different ways. One way this is accomplished is by notching body 120 in alignment with the compensating apertures. This is seen most clearly in FIGS. 12-14. A second way this is accomplished in the embodiments FIGS. 8-14 is by the shape of body 120. Referring to FIGS. 9 and 10, it can be seen that because of the tapered shape of body 120 caused by tapered sides 123 and 124, closed side 125 is longer than reduced side 126. This contributes to more surface area of the compensating apertures facing in a positive direction than in a negative direction.

It is to be understood that the embodiments, and claims are not limited in application to the details of construction, and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. A muzzle brake comprising:

a body having a muzzle end, an exit end opposite to the muzzle end, and at least one side connecting the muzzle end to the exit end;

a muzzle aperture in the muzzle end;

a projectile aperture in the exit end, the projectile aperture having sufficient depth to intersect the muzzle aperture, the muzzle aperture and the projectile aperture being aligned about a projectile line;

a first compensating aperture through the body between the muzzle end and the exit end of the body, the first compensating aperture being a cylinder, the first compensating aperture having its generating line perpendicularly intersecting the projectile line, the first compensating aperture having a baffle side, a containment side, and a vented side, each side having two opposing ends and each having a length perpendicular to the projectile line and the containment side and the vented side having a width parallel to the projectile line, the baffle side facing the muzzle end and having a proximal edge and a distal edge, the containment side of the first compensating aperture being connected to the proximal edge of the baffle side, and the vented side of the first compensating aperture being connected to the distal edge of the baffle side;

a first pair of vent notches at the vented side of the first compensating aperture, the first pair of vent notches passing from the first compensating aperture through the body to external of the body, the first pair of vent notches reducing the length of the vented side of the first compensating aperture to less than the length of the containment side of the first compensating aperture.

2. The muzzle brake of claim 1, wherein:

the proximal edge of the baffle side is closer to the muzzle end than is the distal edge of the baffle side.

3. The muzzle brake of claim 1, wherein:

the width of the vented side of the first compensating aperture is greater than the width of the containment side of the first compensating aperture.

4. The muzzle brake of claim 1, wherein:

the body has a plurality of sides connecting the muzzle end and the exit end.

5. The muzzle brake of claim 1, wherein:

the intersection of the generating line of the first compensating aperture and the projectile line define a plane; and each of the vent notches has sides oriented perpendicular to the plane defined by the intersection of the generating line of the first compensating aperture and the projectile line.

6. The muzzle brake of claim 1, further comprising:

a second compensating aperture through the body between the first compensating aperture and the exit end of the body, the second compensating aperture being a cylinder, the second compensating aperture having its generating line perpendicular to the projectile line and parallel to the generating line of the first compensating aperture, the second compensating aperture having a baffle side, a containment side, and a vented side, each side having two opposing ends and each having a length perpendicular to the projectile line and the containment side and the vented side having a width parallel to the projectile line, the baffle side of the second compensating aperture facing the muzzle end and having a proximal edge and a distal edge, the containment side of the second compensating aperture being connected to the proximal edge of the baffle side of the second compensating aperture, and the vented side of the second compensating aperture being connected to the distal edge of the baffle side of the second compensating aperture; and, a second pair of vent notches at the vented side of the second compensating aperture, the vent notches passing from the second compensating aperture through the body to external of the body, the second pair of vent notches reducing the length of the vented side of the second compensating aperture to less than the length of the containment side of the second compensating aperture.

7. The muzzle brake of claim 6, wherein:

the proximal edge of the baffle side of the second compensating aperture is closer to the muzzle end than is the distal edge of the baffle side of the second compensating aperture.

8. The muzzle brake of claim 6, wherein:

the body has a plurality of sides connecting the muzzle end and the exit end.

9. The muzzle brake of claim 1, further comprising:

a plurality of additional compensating apertures through the body between the first compensating aperture and the exit end of the body, each additional compensating aperture being a cylinder, each additional compensating aperture having its generating line perpendicularly intersecting the projectile line and parallel to the generating line of the first compensating aperture, each additional compensating aperture having a baffle side, a containment side, and a vented side, each side having two opposing ends and the baffle side, containment side, and the vented side of each additional compensating aperture each having a length perpendicular to the projectile line and the containment side and the vented side of each additional compensating aperture having a width parallel to the projectile line, the baffle side of each additional compensating aperture facing the muzzle end and having a proximal edge and a distal edge, the containment side of the each additional compensating aperture being connected to the proximal edge of the respective baffle side of each additional compensating aperture, and the vented side of each additional compensating aperture being connected to the distal edge of the respective baffle side of each additional compensating aperture; and, an additional pair of vent notches at the vented side of each additional compensating aperture, each additional pair of vent notches passing from the respective additional compensating aperture through the body to external of the body, each additional pair of vent notches reducing the length of a vented side of the respective additional compensating aperture to less than the length of a containment side of the respective compensating aperture.

10. The muzzle brake of claim 9, wherein:

the intersection of the generating line of the first compensating aperture and the projectile line define a plane; and each vent of each additional pair of notches has sides oriented perpendicular to the plane defined by the intersection of the generating line of the first compensating aperture and the projectile line.

11. The muzzle brake of claim 9, wherein:

the proximal edge of the baffle side of a given additional compensating aperture is closer to the muzzle end than is the distal edge of the baffle side of that given additional compensating aperture.

12. The muzzle brake of claim 9, wherein:

the body has a plurality of sides connecting the muzzle end and the exit end.

* * * * *